United States Patent [19]

Matumura

[11] Patent Number: 4,611,638

[45] Date of Patent: Sep. 16, 1986

[54] AUTOMATIC TAKE-UP MOTION OF LOOM

[75] Inventor: Hideki Matumura, Tokyo, Japan

[73] Assignee: Nissan Motor Co., Ltd., Yokohama, Japan

[21] Appl. No.: 753,572

[22] Filed: Jul. 10, 1985

[30] Foreign Application Priority Data

Jul. 12, 1984 [JP] Japan ..... 59-143214

[51] Int. Cl.[4] ..... D03D 49/20

[52] U.S. Cl. ..... 139/304; 242/74

[58] Field of Search ..... 139/304, 305, 306, 307, 139/308; 242/56 R, 66 R, 74, 56 A

[56] References Cited

U.S. PATENT DOCUMENTS 1,629,154 5/1927 Ybarrondo ..... 242/74

2,567,387 9/1951 Link ..... 242/74

3,527,424 9/1970 Goldman ..... 242/74

FOREIGN PATENT DOCUMENTS 2620894 3/1977 Fed. Rep. of Germany ..... 139/304

*Primary Examiner*—Henry S. Jaudon

*Attorney, Agent, or Firm*—Schwartz, Jeffery, Schwaab, Mack, Blumenthal & Evans

[57] ABSTRACT

A take-up motion of a loom consists of a cloth roller which is hollow and formed with a plurality of perforations distributedly located in a cylindrical section thereof. The hollow inside of the cloth roller is communicated with an air suction device in such a manner that air around the cloth roller cylindrical section can be sucked into the cloth roller hollow inside, so that a woven cloth is adhered on the cloth roller to be mechanically and automatically wound thereon.

12 Claims, 6 Drawing Figures

AUTOMATIC TAKE-UP MOTION OF LOOM

BACKGROUND OF THE INVENTION

1. Field of the Invention

This invention relates generally to an improvement in a take-up motion of a loom by which a woven cloth is wound on a cloth roller, and more particularly to an automatically operated take-up motion by which the woven cloth can be automatically wound on the cloth roller without any operator's manipulation.

2. Description of the Prior Art

Looms are usually equipped with a take-up motion including a cloth roller driven in timed relation to the operational cycle of the loom, in which a woven cloth is finally wound up on the rotating cloth roller.

However, such an operation as to wind the woven cloth on the cloth roller has been manually carried out by an operator, thereby requiring the operator and a considerably long time therefor. This deteriorates the operation efficiency of the loom.

SUMMARY OF THE INVENTION

A take-up motion of a loom of the present invention consists of a cloth roller on which a woven cloth is wound up. The cloth roller is hollow and formed with a plurality of perforations distributedly located in a cylindrical section thereof. The hollow inside of the cloth roller is communicated with an air suction device in such a manner that air around the cloth roller is sucked into the cloth roller hollow inside when the air suction device is operated.

Accordingly, such an operation as to wind the woven clotch on the cloth roller can be mechanically and automatically carried out without requiring any operator's manipulation, thus improving the operation efficiency of the loom while achieving lavor saving.

BRIEF DESCRIPTION OF THE DRAWINGS

The features and advantages of the take-up motion of the present invention will be more clearly appreciated from the following description taken in conjunction with the accompanying drawings in which same reference numerals designate same parts and elements, and in which.

DETAILED DESCRIPTION OF THE INVENTION

Figure 1:
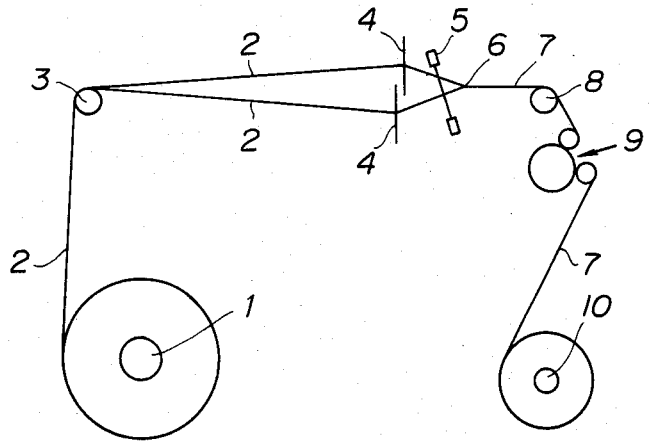
FIG. 1 is a schematic illustration showing a weaving process of a loom equipped with a take-up motion.

Referring to FIGS. 2 to 6, there is shown an embodiment of a take-up motion of a loom, according to the present invention. The take-up motion forms part of a warp yarn feeding and cloth take-up arrangement of FIG. 1. In FIG. 1, the warp yarn feeding and take-up arrangement includes a warp beam 1 on which warp yarns 2 are wound. The warp yarns 2 are fed through a back roller 3 to healds 4 which serve to form the shed of the warp yarns 2 into which a weft yarn (not shown) is picked. The picked weft yarn is beaten up against the cloth fell 6 by a reed 5, thereby making a woven cloth 7. The woven cloth 7 is rolled up on a cloth roller 10 via a guide bar 8 and a weaving density regulating mechanism 9.

Figure 3:
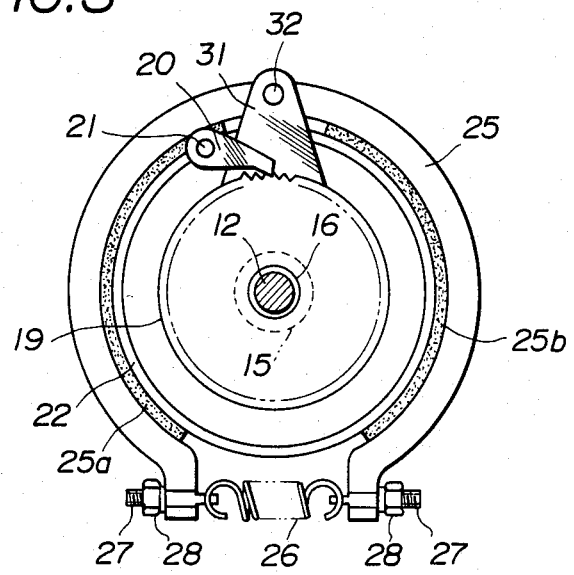
FIG. 3 is an enlarged fragmentary side view taken in the direction of the arrows substantially along the line 3—3 of FIG. 2.

As shown in FIGS. 2 to 6, the take-up motion of the present invention comprises the cloth roller 10 which is driven by a drive shaft 12 which is rotatably supported through bearings 13, 14 on a frame 11 of the loom. A cylindrical shaft 15 is rotatably mounted through bearings 16 in such a manner that the drive shaft 12 passes through the bore of the cylindrical shaft 15. The cylindrical shaft 15 is integrally formed with a sprocket 17 which is driven through a chain 18 by a main shaft (not shown) of the loom, so that the cylindrical shaft is rotatable in timed relation to the operational cycle of the loom. Additionally, the cylindrical shaft 15 is integrally formed at its one end section with a latchet wheel 19. The latchet wheel 19 is prevented from its reverse rotation by pawls 20 which are rotatably mounted on a spindle 21 fixed to the frame 11 as best shown in FIG. 3.

A brake wheel 22 is mounted on the shaft 12 and secured in position by means of a key 23 and a bolt 24. The brake wheel 22 is provided with a generally C-shaped brake shoe 25 which fits on the periphery of the brake wheel 22 as best shown in FIG. 3. Brake linings **25*a*, 25*b* are fixedly disposed on the inner peripheral surface of the brake shoe 25 at the opposite sections. A tension spring 26 is extended between the opposed ends of the generally C-shaped brake shoe 25. More specifically, the opposite end sections of the tension spring 26 are hooked to adjustment screws 27, 27, respectively, which are screwed in the opposite end sections of the brake shoe 25. Each adjustment screw 27 is provided with a nut 28 for fixing the adjustment screw 27** in position.

The cylindrical shaft 15 is integrally formed at the other end thereof with a flange 29 to which an arm 31 is connected by means of a bolt 30. The end section of the arm 31 is connected to the middle portion of the C-shaped brake shoe 25 by means of a connecting pin 32 as best seen from FIG. 3. More specifically, the base end section of the pin 32 is screwed in the arm 31 while the elongated section of the same is passed through the brake shoe 25 and secured in position.

Figure 4:
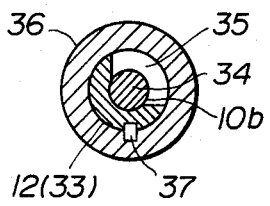
FIG. 4 is an enlarged fragmentary sectional view taken in the direction of the arrows substantially along the line 4—4 of FIG. 2.

The cloth roller 10 includes two opposite end sections $E_1$, $E_2$ which are located coaxially and spaced from each other. A cylindrical plate member C is so fixedly disposed as to connect the end sections $E_1$, $E_2$. Each end section $E_1$, $E_2$ is integrally formed with a shaft portion (no numeral) which axially projects outwardly and has a large-diameter part **10*a* and a small-diameter part 10*b*. Additionally, each end section $E_1$, $E_2$ is integrally formed at its end face with a plurality of projections 10*c* each of which projects outwardly in parallel with the axis of the cloth roller 10. The one end section of the drive shaft 12 and one end section of a cloth roller receiving or supporting shaft 33 are respectively formed with cylindrical supporting faces 34 on each of which the small-diameter part 10*b* of the shaft portion is rotatably supported as shown in FIG. 4. The cylindrical supporting face 34 occupies a part of a circle in cross-section, thereby forming an opening or cutout portion 35 through which the small-diameter section 10***b* can be got off from the cylindrical supporting face 34. The opening 35 is formed by axially cutting the end section of the shaft 12, 33 at a cross-sectional angle of about 90 degrees as shown in FIG. 4.

A coupling 36 slidably fits both on the drive shaft 12 and the large-diameter section 10*a* of the end section $E_2$ and is secured to the drive shaft 12 by means of a key 37, so that the coupling 36 rotates together with the drive shaft 12 as a single member as best seen from FIG. 4. The coupling 36 is formed on its one end face with a projection 36*a* which engages with the above-mentioned projection 10*c* of the end section $E_2$ of the cloth roller 10. As seen from FIG. 5, the drive shaft 12 is formed with a circular groove 38 along the periphery thereof. Additionally, a U-shaped clip member 39 is removably fitted in the circular groove 18 in order to maintain an engaging state between the coupling 36 and the cloth roller 10.

Figure 5:
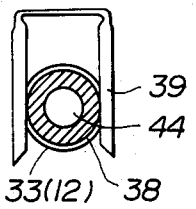
FIG. 5 is an enlarged fragmentary side view taken in the direction of the arrows substantially along the line 5—5 of FIG. 2.

In addition, a sleeve 40 slidably fits both on the fixed receiving shaft 33 and the large-diameter part 10*a* of the shaft portion of the end section $E_1$ of the cloth roller 10. The receiving shaft 33 is formed with a circular groove 38 along the periphery thereof as shown in FIG. 5. A U-shaped clip member 39 is removably fitted in the circular groove 38 in order to prevent the sleeve 40 from displacement when the sleeve 40 is in the position of FIG. 2.

In this embodiment, the cylindrical plate member C defining a hollow inside 42 thereinside is distributedly formed with plurality of small perforations 41 through which the hollow inside of the cloth roller 10 is communicable with atmospheric air around the cloth roller 10. The shaft portion (having the parts 10*a*, 10*b*) of the end section $E_1$ of the cloth roller 10 is axially formed with a communicating opening 43 through which the hollow inside 42 of the cloth roller 10 is communicated with a communicating opening 44 formed axially through the receiving shaft 33. The communicating opening 44 merges in the opening 35 and is communicated through a hose 46 with an air suction device or pump 45. Additionally, a bushing-shaped seal 47 made of rubber or plastic is provided on the inner surface of the sleeve 40 bridging between the receiving shaft 33 and the shaft portion of the cloth roller end section $E_1$, thereby improving air-tight seal of the sleeve 40.

The manner of operation of the thus configurated take-up motion will be discussed hereinafter.

Figure 2:
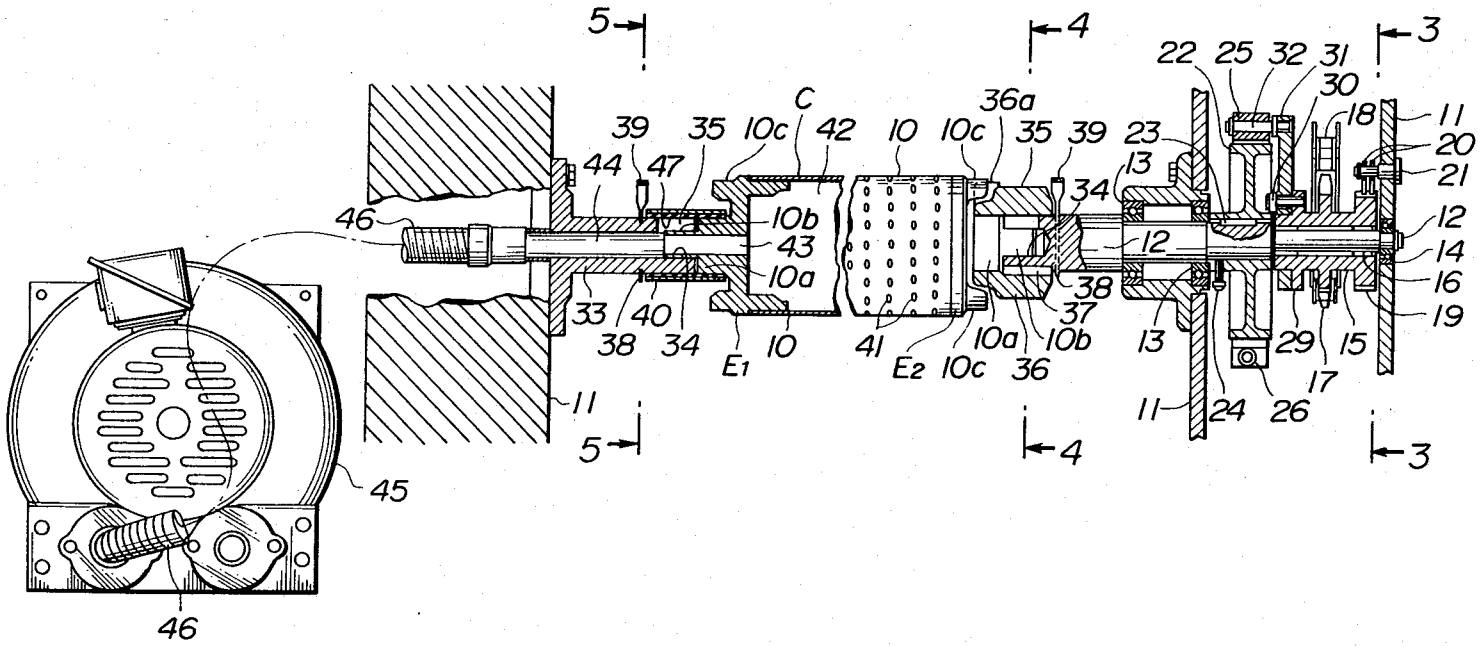
FIG. 2 is a front view, partly in section, of an embodiment of a take-up motion of the present invention.
Figure 6:
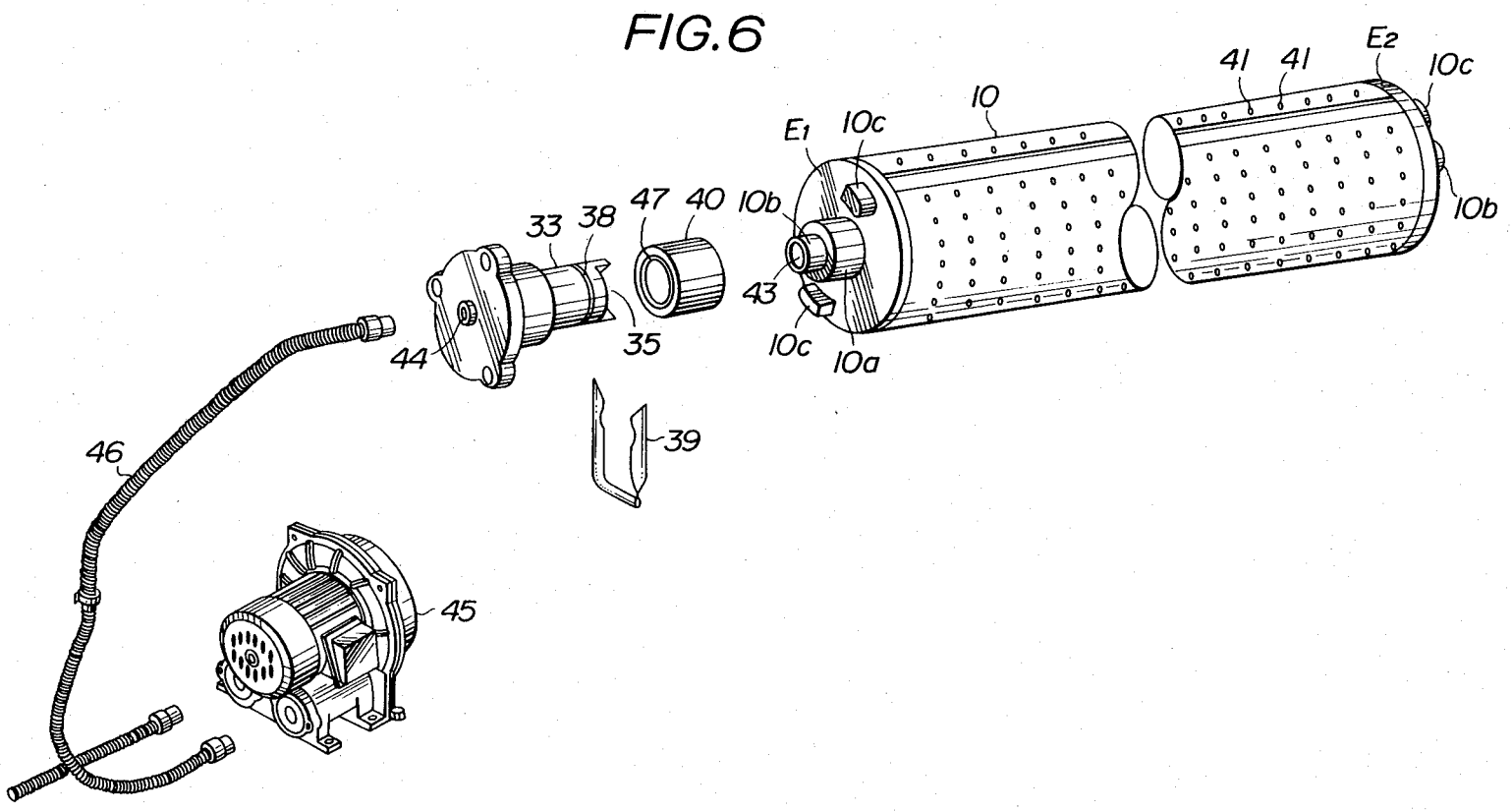
FIG. 6 is an exploded perspective view of an essential part of the take-up motion of FIG. 2.

The cloth roller 10 is being supported in the state of FIG. 2 during operation of the loom. With the revolution of the loom, a rotational force is applied to the brake shoe 25 through the chain 18, the sprocket 17, the cylindrical shaft 15, the flange 29, the bolt 30, the arm 31, and the connecting pin 32. The force applied to the brake shoe 25 is thereafter applied to the brake wheel 22 through the linings 25*a*, 25*b* forced on the brake wheel 22 under the frictional force between the linings 25*a*, 25*b* and the brake wheel 22. The rotation of the brake wheel 22 is transmitted through the key 23 to the drive shaft 12. The rotation of the drive shaft 12 is in turn transmitted through the key 37 to the coupling 36 and further transmitted to the cloth roller 10 through the projections 36*a*, 10*c* which engage with each other, thereby rotating the cloth roller 10. Under the rotation of the cloth roller 10, the woven cloth 7 is wound up on the cloth roller 10, in which the reverse rotation of the drive shaft 12 is prevented under the engagement of the latchet wheel 19 and the pawl 20.

When the wound up woven cloth 7 on the cloth roller 10 has reached a predetermined amount, the loom is temporarily stopped. Then, the clip members 39, 39 are got out from their position. Thereafter, the coupling 36 is moved rightward in FIG. 2 thereby to allow the large-diameter part 10*a* of the shaft portion of the cloth roller end section $E_2$ to get out of the coupling 36. Similarly, the sleeve 40 is moved leftward in FIG. 2 thereby to allow the large-diameter part 10*a* of the shaft portion of the cloth roller end section $E_1$ to get out of the sleeve 40. In this case, in order to prevent the cloth roller 10 from falling off, it is necessary to so adjust the stopping phase of the loom that the openings 35 are faced upward as shown in FIG. 4.

After the woven cloth 7 is cut off at a predetermined position, the cloth roller 10 is got out through the openings 35 upon being supported by a carriage (not shown) or the like. In order to install an empty cloth roller 10 for replacement, the reverse procedure to case of getting out the cloth roller will be carried out.

In this embodiment, when winding of the woven cloth 7 on the cloth roller 10 takes place, the air suction device 45 is operated to suck air within the hollow inside 42 of the cloth roller 10 through the hose 46 and the communicating openings 44, 43, thus sucking ambient air around the cloth roller 10 into the hollow inside 42 of the cloth roller 10. When the woven cloth 7 approaches the cloth roller 10 in this state, the woven cloth 7 is adhered on the surface of the cloth roller 10 under the air suction, so that woven cloth 7 is wound on the cloth roller 10 upon the rotation of the cloth roller 10. In this case, since the seal 47 made of rubber is provided on the inner surface of the sleeve 40, air leak around this section can be effectively prevented at the time of air suction of the air suction device 45, thereby providing a further strong suction force to the cloth roller 10. It will be noted that the above-discussed operation of winding the woven cloth 7 on the cloth roller 10 has been manually carried out in conventional take-up motions of looms.

As will be appreciated from the above, according to the embodiment of the present invention, the operation of winding the woven cloth on the cloth roller 10 can be mechanically and automatically carried out without using any operator's manipulation. Accordingly, labor saving for such an operation can be promoted while improving the operation efficiency of the loom. Furthermore, since the woven cloth is adhered onto the cloth roller under air suction, unreasonable force is not applied to the woven cloth when the woven cloth is wound on the cloth roller, thereby preventing the production of wrinkles on the surface of the woven cloth.

What is claimed is:

1. A take-up motion apparatus for a loom, comprising:

a cloth roller which is hollow and includes a cylindrical section on which a woven cloth is wound, said cylindrical section being distributedly formed with a plurality of perforations through which a hollow inside of said cloth roller is communicable with atmospheric air;

means for rotatably supporting said cloth roller;

means defining a first communicating opening in said rotatably supporting means, said first communicating opening being in communication with the hollow inside of said cloth roller; and air suction means for sucking air from the hollow inside of said cloth roller through said first communicating opening.

2. A take-up motion apparatus as claimed in claim 1, wherein said rotatably supporting means includes a hollow supporting shaft fixed to a stationary member of the loom, said supporting shaft defining therein said first communicating opening.

3. A take-up motion apparatus as claimed in claim 2, wherein said cloth roller includes first and second end sections which are coaxially and spacedly disposed, in which said cylindrical section is fixedly disposed so as to connect said first and second end sections.

4. A take-up motion apparatus for a loom, comprising;

a cloth roller which is hollow and includes a cylindrical section on which a woven cloth is wound, said cylindrical section being distributedly formed with a plurality of perforations through which a hollow inside of said cloth roller is communicable with atmospheric air;

means for rotatably supporting said cloth roller;

means defining a first communicating opening in said rotatably supporting means, said first communicating opening being in communication with the hollow inside of said cloth roller; and air suction means for sucking air from the hollow inside of said cloth roller through said first communicating opening;

wherein said rotatably supporting means includes a hollow supporting shaft fixed to a stationary member of the loom, said supporting shaft defining therein said first communicating opening;

wherein said cloth roller includes first and second end sections which are coaxially and spacedly disposed, in which said cylindrical section is fixedly disposed so as to connect said first and second end sections; and wherein said cloth roller first end section has a hollow shaft portion which axially outwardly extends and is rotatably supported by said supporting shaft, said hollow shaft portion defining thereinside a second communicating opening which merges in the cloth roller hollow inside nd is communicated and aligned with said first communicating opening.

5. A take-up motion apparatus as claimed in claim 4, wherein said hollow shaft portion of said cloth roller first end section includes a first cylindrical part, and a second cylindrical part which axially outwardly extends from said first cylindrical part, said second cylindrical part being smaller in diameter than said first cylindrical part and rotatably supported by said supporting shaft.

6. A take-up motion apparatus as claimed in claim 5, wherein said supporting shaft has a first end section which is formed with a cutout portion extending to an extreme end of the first end section and merging in said first communicating opening, in which said second cylindrical part of said cloth roller first end section shaft portion is rotatably disposed in at least a part of said first communicating opening at said first end section of said supporting shaft, said second cylindrical part being smaller in axial length than said cutout portion.

7. A take-up motion apparatus as claimed in claim 5, further comprising a cylindrical sleeve slidably disposed on and connecting both said supporting shaft and said first cylindrical part of said cloth roller first end section shaft portion.

8. A take-up motion as claimed in claim 7, wherein said suporting shaft is the same in outer diameter as said first cylindrical part of said cloth roller first end section shaft portion.

9. A take-up motion apparatus as claimed in claim 8, further comprising a cylindrical elastomeric seal member which is disposed on inner surface of said cylindrical sleeve and is in sealing contact with the outer surface of said supporting shaft and said first cylindrical part of said cloth roller first end section shaft portion.

10. A take-up motion apparatus for a loom, comprising;

a cloth roller which is hollow and includes a cylindrical section on which a woven cloth is wound, said cylindrical section being distributedly formed with a plurality of perforations through which a hollow inside of said cloth roller is communicable with atmospheric air;

means for rotatably supporting said cloth roller;

means defining a first communicating opening in said rotatably supporting means, said first communicating opening being in communication with the hollow inside of said cloth roller; and air suction means for sucking air from the hollow inside of said cloth roller through said first communicating opening;

wherein said rotatably supporting means includes a hollow supporting shaft fixed to a stationary member of the loom, said supporting shaft defining therein said first communicating opening;

wherein said cloth roller includes first and second end sections which are coaxially and spacedly disposed, in which said cylindrical section is fixedly disposed so as to connect said first and second end sections; and wherein said cloth roller second end section has a shaft portion which axially outwardly extends, said shaft portion including a first cylindrical part, and a second cylindrical part which axially outwardly extends from said first cylindrical part, said second cylindrical part being smaller in diameter than said first cylindrical part.

11. A take-up motion as claimed in claim 10, further comprising a drive shaft which is rotatable in timed relation to operational cycle of the loom, said drive shaft having a first end section to which said cloth roller second end section shaft portion is connected, said first end section being formed with an axially extending opening, and a cutout portion extending to extreme end of said first end section and merging in said axially extending opening, in which said second cylindrical part of said cloth roller second end section shaft portion is rotatably disposed in at least a part of said axially extending opening, said cutout portion being larger in axial length than said second cylindrical part.

12. A take-up motion apparatus as claimed in claim 11, further comprising a generally cylindrical coupling disposed both on said first cylindrical part of said cloth roller second end section shaft portion and said drive shaft, said coupling being fixed in a peripheral direction to said drive shaft and including a projection engageable with a projection formed on said cloth roller second end section.

* * * * *